United States Patent [19]

Koch et al.

[11] Patent Number: 4,781,755

[45] Date of Patent: Nov. 1, 1988

[54] METHOD OF RECOVERING COPPER AND FURNACE FOR CARRYING OUT THE METHOD

[75] Inventors: Erwin Koch, Leonding; Gerhard Glöckler, Ohlsdorf; Heinz Müller, Neuhofen, all of Austria

[73] Assignee: Voest-Alpine Aktiengesellschaft, Austria

[21] Appl. No.: 72,247

[22] Filed: Jul. 10, 1987

[30] Foreign Application Priority Data

Jul. 22, 1986 [AT] Austria ..... 1977/86

[51] Int. Cl.[4] ..... C22B 4/00; C21C 5/52

[52] U.S. Cl. ..... 75/10.19; 75/72

[58] Field of Search ..... 75/72–76, 75/10.19

[56] References Cited

U.S. PATENT DOCUMENTS 3,594,153 7/1971 DeCorso ..... 75/72

4,414,673 11/1983 Lugscheider ..... 373/22

4,423,512 12/1983 Lugscheider ..... 373/22

4,504,307 3/1985 Lugscheider ..... 75/10 R

*Primary Examiner*—Peter D. Rosenberg

*Attorney, Agent, or Firm*—Ostrolenk, Faber, Gerb & Soffen

[57] ABSTRACT

A method of recovering copper from oxidic and/or silicate copper ores by way of pyrometallurgy. With this method, the copper ores are melted in a reaction zone heated by plasma jets and maintained at a temperature of at least 1,500° C. At this high temperature, the thermal decomposition of the oxidic or silicate copper compounds occurs, whereas no such decomposition of accompanying metal oxides takes place. The furnace used to perform this method includes a refractory lining of carbonless material. The reaction furnace and, thus, the reaction zone are sealed relative to the atmosphere to prevent oxygen from entering thereinto. An inert gas is used as plasma gas.

7 Claims, No Drawings

METHOD OF RECOVERING COPPER AND FURNACE FOR CARRYING OUT THE METHOD

The invention relates to a method of recovering copper from oxidic and/or silicate copper ores by way of pyrometallurgy, as well as to a furnace for carrying out the method.

It is known to melt oxidic copper ores on crude copper (black copper) in shaft or open hearth furnaces upon addition of coke as reductant. These methods have the disadvantage that the metallic copper obtained is contaminated due to the undesired co-reduction of other oxides (iron, silicon, cobalt oxides); usually, the slags are highly viscous, thus requiring the addition of large amounts of basic slag formers. In addition, the fine ores and flotation concentrates utilized must be agglomerated prior to the melting process.

For the reasons indicated, available ores having copper contents of up to 30% Cu hitherto have not been processable by way of pyrometallurgy in a satisfactory manner.

The invention aims at avoiding the disadvantages and difficulties pointed ou, and has as its object to provide a method of recovering copper from oxidic and/or silicate copper ores by way of pyrometallurgy, with which the output of the copper contained in the ores is as large as possible, the product obtained is of a great purity, i.e., free of other accompanying metals, a slighter amounts of fluxes is required for the process than hitherto, and it has been rendered possible to operate with low-viscous slags, thus ensuring the easy separation of the slag from molten copper. Furthermore, the invention is to render possible the processing of copper ores or concentrates with lower copper contents than so far, for instance with copper contents of about 10 to 20%.

In accordance with the invention, this object is achieved with a method of the initially described kind in that the copper ores are melted in a reaction zone heated by plasma jets, and are heated to a temperature of at least 1,500° C. so as to effect the thermal decomposition of the oxidic or silicate copper compounds.

According to a preferred embodiment, the reaction is carried out in a furnace adapted to be sealed relative to the atmosphere in order to prevent oxygen from entering, and the plasma jet(s) is/are formed upon addition of an inert gas, preferably argon, to the plasma burners.

The method of the invention is based on that, in the burning center of the plasma jets, temperatures of such heights occur on the slag surface that copper oxide ($Cu_2O$) will be thermally decomposed without utilizing an additional reductant, such as C, yet the oxygen pressures of all the other accompanying metals remain sufficiently low to prevent the thermal decomposition of the oxides of other metals.

From this property of copper oxide to be thermally decomposed as in contrast to the oxides of accompanying metals, the advantages of a lower heat demand and lower exhaust gas amounts, of the method according to the invention result. In addition, the high temperatures prevailing in the reaction zone cause the slag to be of a low viscosity in the molten state despite the use of silicate ores, metal and slag thus separating easily.

According to a further preferred embodiment, CaO-containing slag formers may be added to the copper ore burden in order to reduce the viscosity of the acid slag formed in the reaction zone.

In some cases, it may be suitable within the scope of invention—preferably towards the end of the thermal decomposition process—to add to the copper ore burden carbonaceous fluxes in an under-stoichiometric amount relative to the reduction of copper oxide ($Cu_2O$) in order to keep residual contents of copper in the slag as low as possible.

Preferably, the temperature of the slag is maintained at 1,600° C. at least.

Feeding of the copper ore burden may be effected in a continuous manner.

The invention, furthermore, comprises a furnace for carrying out the method, which furnace comprises a refractory lining, a bottom electrode and one or several plasma burner(s) guided through the furnace lid, and is characterized in that the lining of the bottom and of the wall of the furnace is composed of refractory carbonless material, preferably or an outer lining of leightweight refractory brick and a working lining of refractory concrete on $Al_2O_3$, $Cr_2O_3$, $Fe_2O_3$ and CaO basis.

Advantageously, a copper electrode may be provided as the bottom electrode.

The method according to the invention will be explained in more detail by way of the following example:

Into a plasma furnace having a clear width of 40 cm, a bottom and a wall lined with a carbonless lining and a sealable lid through which an argon-operated plasma burner was guided, with a copper electrode being provided on its bottom, 23.5 kg of an oxidic copper concentrate were continuously charged and melted therein over a period of 3 hours.

The copper concentrate had the following composition:

| Cu | Co | CaO | MgO | $SiO_2$ | FeO | $Al_2O_3$ | S | $P_2O_5$ | Loss due to burning | Humidity |
|---|---|---|---|---|---|---|---|---|---|---|
| 21.30% | 1.31% | 4.48% | 6.90% | 29.99% | 2.80% | 2.93% | 1.35% | 0.275% | 16.34% | 3.40% |

Towards the end of continuous charging, a mean temperature of the liquefied charged material of 1,700° C. was determined. After 3 hours from the beginning of charging, slag and metal were tapped in a molten state. The copper yield was 4.8 kg, i.e., 94%. The composition of the metallic copper was as follows:

| Cu | Si | Al | Mg | S | P |
|---|---|---|---|---|---|
| 98.5% | less than 0.01% | 0.001% | 0.001% | 0.81% | less than 0.002% |

There were detectable only traces of iron and cobalt. The composition of the residual slag was as follows:

| Cu | Co | CaO | MgO | $SiO_2$ | FeO | $Al_2O_3$ |
|---|---|---|---|---|---|---|
| 2.6% | 2.63% | 9.0% | 13.88% | 60.33% | 5.63% | 5.89% |

The test was repeated upon addition of 4.7 kg CaO and 1 kg coke to the burden. However, with a yield of 98.5% copper, an iron content of 0.85% and a cobalt content of 0.8% were determined. The copper content in the residual slag was 0.3%.

What we claim is:

1. A method of recovering copper from a burden comprising at least one of oxidic and silicate copper compounds by way of pyrometallurgy, wherein a reaction zone is provided and heated by at least one plasma jet emitted from plasma burner means, and said copper compounds are melted in said reaction zone and are heated to a temperature of at least 1,500° C., and reaction zone maintaining an oxygen partial pressure sufficiently low so as to cause the thermal decomposition of said copper compounds without thermal decomposition of oxides of other metals present in said copper compounds, wherein said reaction is carried out in a sealable furnace, and wherein said reaction is carried out without adding a reducing agent to said burden.

2. A method as set forth in claim 1, wherein an inert gas is supplied to said plasma burner means to form said at least one plasma jet.

3. A method as set forth in claim 2, wherein said inert gas essentially consists of argon.

4. A method as set forth in claim 1, wherein acid slag is formed in said reaction zone and CaO-containing slag formers are added to said copper compound burden so as to lower the viscosity of said acid slag.

5. A method as set forth in claim 1, further comprising adding carbonaceous fluxes to said copper compound burden in understoichiometric amounts relative to said reduction of copper oxide ($Cu_2O$).

6. A method as set forth in claim 4, wherein the temperature of said slag is maintained at at least 1,600° C.

7. A method as set forth in claim 1, wherein said copper compound burden is supplied continuously.

* * * * *